US008409068B2

(12) United States Patent
Akatsu et al.

(10) Patent No.: US 8,409,068 B2
(45) Date of Patent: Apr. 2, 2013

(54) CENTRIFUGE WITH VACUUM PUMP AND CONTROL METHOD THEREOF

(75) Inventors: Kouichi Akatsu, Hitachinaka (JP); Masahiro Inaniwa, Hitachinaka (JP); Hisanobu Ooyama, Hitachinaka (JP); Shinichi Haruki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 268 days.

(21) Appl. No.: 12/844,484

(22) Filed: Jul. 27, 2010

(65) Prior Publication Data

US 2011/0021332 A1 Jan. 27, 2011

(30) Foreign Application Priority Data

Jul. 27, 2009 (JP) ..... 2009-174538

(51) Int. Cl.
*B04B 13/00* (2006.01)
*B04B 15/02* (2006.01)
*B04B 15/08* (2006.01)

(52) U.S. Cl. ..... 494/1; 494/11; 494/13; 494/61

(58) Field of Classification Search ..... 494/1, 10–16, 494/23–30, 35, 38–39, 42, 43, 61, 85
See application file for complete search history.

(56) References Cited

U.S. PATENT DOCUMENTS 3,327,938 A * 6/1967 Stallmann ..... 494/15
4,941,866 A * 7/1990 Gorodissky et al. ..... 494/14
8,038,592 B2 * 10/2011 Toi et al. ..... 494/2
2011/0021332 A1 * 1/2011 Akatsu et al. ..... 494/1
2011/0059835 A1 * 3/2011 Takahashi ..... 494/10
2011/0207590 A1 * 8/2011 Ooyama et al. ..... 494/9
2012/0260687 A1 * 10/2012 Inaniwa et al. ..... 62/196.1

FOREIGN PATENT DOCUMENTS

JP 09088900 A 3/1997
JP 2001-104826 4/2001
JP 2001104826 A * 4/2001
JP 2003097500 A 4/2003
JP 2008-023477 2/2008
JP 2009195875 A * 9/2009
JP 2010104944 A * 5/2010
JP 2010-131560 * 6/2010
JP 2011230085 A * 11/2011

OTHER PUBLICATIONS

Japanese Office Action, and English translation thereof, issued in Japanese Patent Application No. 2009-174538 dated Jul. 25, 2012.

* cited by examiner

*Primary Examiner* — Charles E Cooley
(74) *Attorney, Agent, or Firm* — McDermott Will & Emery LLP

(57) ABSTRACT

A centrifuge comprises a rotor for holding a sample, a rotation chamber for housing the rotor, a motor for rotating the rotor, an oil diffusion pump for reducing a pressure within the rotation chamber, and a control unit for controlling the heater temperature of the oil diffusion pump for a target set temperature. The control unit changes the target set temperature from a first given temperature to a second given temperature that is lower than the first given temperature after a given period of time elapses since the start of control of the heater temperature.

15 Claims, 9 Drawing Sheets

CENTRIFUGE WITH VACUUM PUMP AND CONTROL METHOD THEREOF

CROSS-REFERENCE TO RELATED APPLICATION

This application claims the benefit of Japanese Patent Application No. 2009-174538, filed on Jul. 27, 2009, the entire disclosure of which is incorporated by reference herein.

FIELD

This application relates generally to a centrifuge and control method thereof, and more particularly, to a centrifuge comprising an oil diffusion pump and a control method thereof.

BACKGROUND

A centrifuge separates and purifies a sample while the rotor holding the sample and placed in the rotation chamber is rotated at a high speed by a drive unit.

The Unexamined Japanese Patent Application KOKAI Publication Nos. 2001-104826 and 2008-23477 disclose ultracentrifuges with a rotor rotation speed of 40,000 rpm or higher. Such a centrifuge comprises a vacuum pump unit reducing the pressure within the rotation chamber to a high vacuum state and a control unit controlling the operation of the vacuum pump unit and drive unit in order to prevent rise in temperature of the rotor and sample due to frictional heat caused by windage loss between the rotor and the air in the rotation chamber.

The vacuum pump unit is constructed by series-connecting an auxiliary vacuum pump reducing the pressure from the atmospheric pressure to a high degree of vacuum such as approximately 13 Pascal and an oil diffusion pump reducing the pressure from the high degree of vacuum to an ultrahigh degree of vacuum. The oil diffusion pump includes a boiler for heating the stored oil, a heater for heating the boiler, a jet part that allows the oil molecules heated by the boiler and evaporated/gasified to pass through the center and ejects them downward in one direction from the periphery, a cooling part which cools and liquefies the high-speed oil molecules ejected from the jet part and colliding against the wall thereof and in whose lower part the surrounding gas molecules blown off by the oil molecules are compressed, an air inlet connected to the rotation chamber, an air outlet connected to the auxiliary vacuum pump, and so on.

In order to prevent rise in temperature of the rotor and sample, the control unit performs so-called vacuum standby operation in which the rotor is rotated at a predetermined low fixed rotation speed such as approximately 5,000 rpm until the rotation chamber reaches a moderate degree of vacuum such as 133 Pascal from the atmospheric pressure. Then, the control unit accelerates the rotor to a rotation speed of several tens of thousands rpm to more than a hundred-thousand rpm after the rotation chamber has reached a moderate degree of vacuum.

For centrifugal separation of a sample for which rise in temperature should be prevented as much as possible, an operator performs so-called high vacuum start operation in which the rotor is rotated only after the rotation chamber has reached a high degree of vacuum such as approximately 13 Pascal.

The centrifuge disclosed in the Unexamined Japanese Patent Application KOKAI Publication No. 2001-104826 controls the operation of the oil diffusion pump based on the temperature of the heater for evaporating/gasifying the oil in the oil diffusion pump that is detected by a temperature sensor. The centrifuge disclosed in the Unexamined Japanese Patent Application KOKAI Publication No. 2008-23477 controls the operation of the oil diffusion pump based on the degree of vacuum in the rotation chamber that is detected by a vacuum sensor.

In the above-described prior art centrifuges, it takes more than 10 minutes for the rotation chamber to reach a high degree of vacuum of approximately 13 Pascal in the high vacuum start operation. Therefore, it takes a long time before the centrifugal separation starts, leading to poor work efficiency. Furthermore, even though the pressure within the rotation chamber is reduced to a high degree of vacuum of approximately 13 Pascal, the sample temperature will be raised because of windage loss of the rotor when the centrifugal separation is performed under high centrifugal force for a prolonged time with the rotor being rotated at a rotation speed of several tens of thousands rpm to more than a hundred-thousand rpm. Consequently, in such a case, the pressure within the rotation chamber should be reduced to an ultrahigh degree of vacuum of approximately 1 Pascal.

Needless to say, a prior art centrifuge is provided with a means for maintain the inner wall surface of the rotation chamber at a proper temperature using a Peltier element or the like so as to cool the rotor rotating at a high speed. However, when the pressure within the rotation chamber is at a high vacuum state, convective air flow cannot be utilized; therefore, the rotor-cooling power is low. Then, windage loss of the rotor and frictional heat between the rotor and air should be kept low by maintaining a ultrahigh degree of vacuum around the rotor.

A powerful heater or even a cartridge heater that allows for efficient heat transfer from the heater to the oil can be used to heat the oil in the oil diffusion pump, thereby reducing the time to evaporate/gasify the oil in the oil diffusion pump and then reducing the time for the rotation chamber to reach a high degree of vacuum from the atmospheric pressure approximately to half. Furthermore, the boiler can be maintained at a high temperature so that the oil in the oil diffusion pump is vigorously evaporated/gasified, whereby the rotation chamber is maintained at an ultrahigh degree of vacuum.

However, the quantity of oil molecules evaporated/gasified and ejected from the jet part is increased as the boiler is maintained at a high temperature. In such a case, some of the gasified oil molecules are not sufficiently cooled and continuously discharged from the air outlet of the oil diffusion pump to the auxiliary vacuum pump. Then, the amount of oil stored in the oil diffusion pump is reduced and frequent oil supply maintenance service is required. Furthermore, the air outlet of the oil diffusion pump and the auxiliary vacuum pump are often connected by a rubber vacuum hose. When the heater is kept at a high temperature, the connection part between the air outlet of the oil diffusion pump (so-called elbow part) and the rubber vacuum hose is heated and an inexpensive natural rubber vacuum hose is subject to premature thermal degradation. Therefore, an expensive silicon rubber vacuum hose must be used, increasing the product cost.

The above problems can be resolved by using a powerful heater so as to allow the rotation chamber to reach an ultrahigh degree of vacuum in a short time and, once the rotation chamber has reached an ultrahigh degree of vacuum, detecting the heater temperature having a good temperature response as the boiler temperature and maintaining the boiler temperature at a proper temperature for maintaining low oil consumption of the oil diffusion pump and preventing high temperatures at the air outlet.

However, a significantly narrow range of proper oil temperatures in the oil diffusion pump realizes the above ideal state. Furthermore, for properly controlling the boiler temperature, detection errors of a temperature sensor detecting the heater temperature and other measurement errors should be taken into account. Therefore, it is advantageous that the target set temperature of the heater (the target set temperature of the oil in the oil diffusion pump) is lower than the optimum temperature.

In the above described oil diffusion pump using a powerful heater, the temperature of the oil in the oil diffusion pump will be rapidly raised by the heater and, once approached the target set temperature, stabilized at the target set temperature by controlling the temperature of the heater. Here, the temperatures of the heater and oil tend to be subject to hunting in which overshoot and undershoot are repeated with the time. The degree of vacuum in the rotation chamber is increased when the oil temperature is high (overshoot) and, conversely, is decreased when the oil temperature is low (undershoot). Therefore, the degree of vacuum of the rotation chamber also tends to be subject to hunting.

Operation of the above oil diffusion pump in a prior art centrifuge will be described hereafter with reference to FIGS. 8 and 9. FIG. 8 is an operation flowchart showing the oil diffusion pump heater control of the control unit of a prior art centrifuge by way of example. FIG. 9 is a characteristic chart showing the chronological change in the heater temperature of the oil diffusion pump and the degree of vacuum in the rotation chamber in a prior art centrifuge that was measured during the oil diffusion pump heater control in FIG. 8.

For starting the operation of the vacuum pump unit, the control unit activates the auxiliary vacuum pump to reduce the pressure within the rotation chamber and, as shown in FIG. 6, starts continuously energizing (continuously heating) the heater of the oil diffusion pump to rapidly raise the heater temperature (Step S31). Then, the control unit monitors the heater temperature corresponding to the temperature of the oil in the oil diffusion pump based on detection signals from a temperature sensor attached to the heater (Step S32) and continues to continuously energize the heater until the heater temperature reaches a target set temperature Tctl-10° C. (Step S32, NO).

Once the heater temperature reaches the target set temperature Tctl-10° C. (Step S32, YES), the control unit controls the pulse width of the electric power supplied to the heater through PID feedback control and the like so that the heater temperature becomes equal to the target set temperature Tctl (Step S33). Subsequently, the control unit continues the procedure in Step S33 until the centrifugal separation is completed, the rotor is stopped, and the energization of the heater is discontinued (Step S35, NO).

After the control unit starts continuously heating the heater, the heater temperature of the oil diffusion pump (the temperature of the oil in the oil diffusion pump) linearly rises until it reaches the target set temperature Tctl-10° C. as shown in FIG. 8. Once the heater temperature reaches the target set temperature Tctl-10° C. and the control unit moves on to the pulse width control of the electric power supplied to the heater, the heater temperature reaches the target set temperature Tctl.

However, because a powerful heater is used for heating the oil in the oil diffusion pump, the heater temperature gradually stabilizes at the target set temperature Tctl after repeated hunting between overshoot Tov1 and undershoot Tun1.

Fluctuation in the heater temperature leads to fluctuation in the oil temperature in the oil diffusion pump, which further leads to fluctuation in the quantity of oil molecules ejected from the jet part in the oil diffusion pump. Therefore, the rotation chamber reaches a target ultrahigh degree of vacuum Pmg after repeated hunting between undershoot Pun1 and overshoot Pov1. For this reason, prior art centrifuges have the problem that the time for the rotation chamber to reach a target ultrahigh degree of vacuum Pmg since the start of operation of the vacuum pump unit can not be shortened.

In this regard, continuous control for an increased target set temperature Tctl leads to the problem that the oil consumption of the oil diffusion pump is increased and the temperature at the air outlet is raised as described above. On the other hand, continuous control for a decreased target set temperature Tctl leads to the problem that the oil temperature in the oil diffusion pump is lowered and the quantity of gasified oil molecules ejected from the jet part is reduced, whereby the rotation chamber fails to reach an ultrahigh degree of vacuum in a short time.

SUMMARY

In view of the above problems, the purpose of the present invention is to provide a centrifuge and control method thereof allowing the rotation chamber to reach an ultrahigh degree of vacuum in a short time while preventing the oil diffusion pump from increasing the oil consumption and raising the temperature at the air outlet.

In order to achieve the above purpose, the centrifuge according to the first aspect of the present invention comprises a rotor for holding a sample, a rotation chamber for housing the rotor, a motor for rotating the rotor, an oil diffusion pump for reducing a pressure within the rotation chamber, and a control unit for controlling the heater temperature of the oil diffusion pump for a target set temperature, wherein the control unit changes the target set temperature from a first given temperature to a second given temperature that is lower than the first given temperature after a given period of time elapses since the start of control of the heater temperature.

Furthermore, the centrifuge control method according to the second aspect of the present invention comprises the steps of:

starting to heat the heater of the oil diffusion pump;

controlling the temperature of the heater for a first given temperature; and controlling the temperature of the heater for a second given temperature that is lower than the first given temperature after a given period of time elapses since the start of heating of the heater.

The heater temperature of the oil diffusion pump is controlled so that it becomes equal to the first given temperature higher than the second given temperature that is determined, for example, to reach and maintain a target degree of vacuum in the rotation chamber, for example, by approximately 2° C. to 10° C., whereby the rotation chamber can reach an ultrahigh degree of vacuum in a shorter time.

Furthermore, after a given period of time, for example 10 minutes to one hour, elapses since the start of control of the heater, the target set temperature of the heater is changed from the first given temperature to the second given temperature, which prevents the oil diffusion pump from increasing the oil consumption or raising the temperature at the air outlet.

Therefore, according to the present invention, the rotation chamber can reach an ultrahigh degree of vacuum in a short time while preventing the oil diffusion pump from increasing the oil consumption or raising the temperature at the air outlet. The present invention is particularly effective when the oil diffusion pump is equipped with a powerful heater or a cartridge heater having high heat transfer efficiency.

Furthermore, with the target set temperature being gradually changed from the first given temperature to the second given temperature, for example, at a rate of approximately 0.1° C. in approximately every 20 seconds, the rotation chamber can reach and maintain an ultrahigh degree of vacuum in a stable manner while preventing hunting in the degree of vacuum due to change in the target set temperature.

Furthermore, experimental results show that when the heating operation in which the target set temperature of the heater is the first given temperature higher than the second given temperature is performed in a short time such as approximately 30 minutes since the start of control of the heater temperature of the oil diffusion pump, the rotation chamber can reach and maintain higher levels of ultrahigh degree of vacuum compared with when no such heating is performed.

BRIEF DESCRIPTION OF THE DRAWINGS

A more complete understanding of this application can be obtained when the following detailed description is considered in conjunction with the following drawings, in which.

DETAILED DESCRIPTION

Embodiments of the present invention will be described hereafter in detail with reference to the drawings. The members or elements having the same function are referred to by the same reference numbers throughout the drawings and their explanation is not repeated.

(Embodiment 1)

Figure 1:
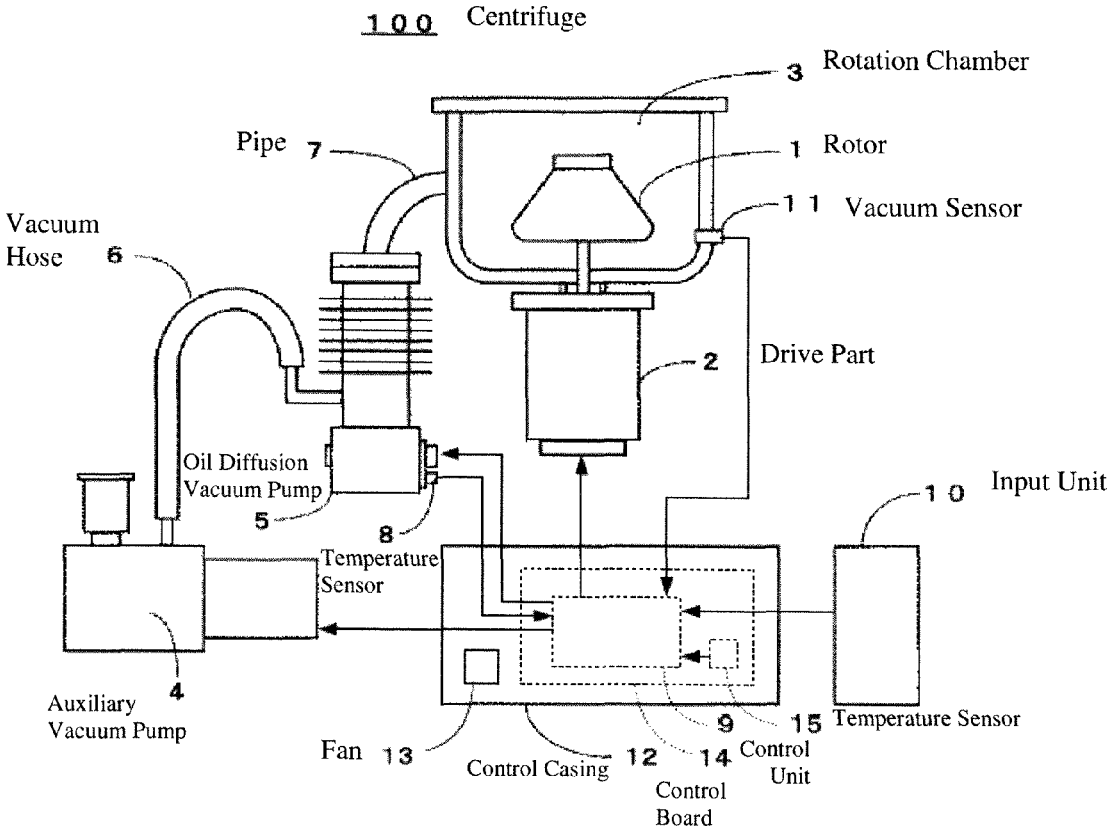
FIG. 1 is an illustration showing the structure of a centrifuge according to an embodiment of the present invention.

FIG. 1 is an illustration showing the structure of a centrifuge 100 according to Embodiment 1 of the present invention. The centrifuge 100 includes a rotor 1, a drive part (motor) 2, a rotation chamber 3, an auxiliary vacuum pump 4, an oil diffusion vacuum pump 5, a vacuum hose 6, a pipe 7, a temperature sensor (a first temperature sensor) 8, a control unit 9, an input unit 10, a vacuum sensor 11, a control casing (enclosure) 12, a fan (ventilation unit) 13, a control board 14, and a second temperature sensor 15.

The rotor 1 is used to mount a sample to be separated. The motor 2 rotates the rotor 1 at high speeds. Housing the rotor 1, the rotation chamber 3 is sealed.

The auxiliary vacuum pump 4 consists of an oil-sealed rotary vacuum pump or dry scroll vacuum pump and reduces the pressure within the rotation chamber 3 to a moderate degree of vacuum such as 20 Pascal. The oil diffusion vacuum pump 5 reduces the pressure within the rotation chamber 3 to an ultrahigh degree of vacuum. The auxiliary vacuum pump 4 and oil diffusion vacuum pump 5 are series-connected to each other to constitute a vacuum pump unit. The vacuum hose 6 connects the auxiliary vacuum pump 4 and oil diffusion vacuum pump 5. The pipe 7 connects the rotation chamber 3 and oil diffusion vacuum pump 5.

The temperature sensor 8 detects the temperature of a heater 5C (see FIG. 2) installed in the oil diffusion vacuum pump 5 and outputs detection signals to the control unit 9. In this embodiment, the temperature of the heater 5C is treated as the temperature of oil 5B (see FIG. 2) in the oil diffusion vacuum pump 5.

The input unit 10 outputs signals indicating operation conditions and start, stop, and other instructions for the centrifuge 100 to the control unit 9 according to user operation.

The vacuum sensor 11 detects the degree of vacuum in the rotation chamber 3 and outputs detection signals to the control unit 9.

The control casing 12 is equipped with the fan (ventilation unit) 13 and houses the control board 14. The control unit 9 and second temperature sensor 15 are mounted on the control board 14.

The control unit 9 includes a microprocessor having an internal timer, a motor driver circuit, a vacuum pump unit control circuit, and so on. The control unit 9 controls the operation of the centrifuge 100, namely the operation of the motor 2, auxiliary vacuum pump 4, oil diffusion vacuum pump 5, and the like, according to instructions from the input unit 10. More specifically, the control unit 9 modulates the pulse width of the electric power supplied to the heater 5C of the oil diffusion pump 5 through PID feedback control and pulse width modulation (PWM) control based on detection signals from the temperature sensor 8 so that the temperature of the heater 5C (the heater temperature) becomes equal to a target set temperature. Furthermore, the control unit 9 uses detection signals from the vacuum sensor 11 as information for the vacuum standby operation or high vacuum start operation of the motor 2.

The second temperature sensor 15 detects the ambient temperature of the control board 14 (the board temperature) housed in the control casing 12 and outputs detection signals to the control unit 9. The control unit 9 has a function of correcting the target set temperature of the heater 5C of the oil diffusion pump 5 based on the detection signals from the second temperature sensor 15. This function will be described in Embodiment 3 described later.

Figure 2:
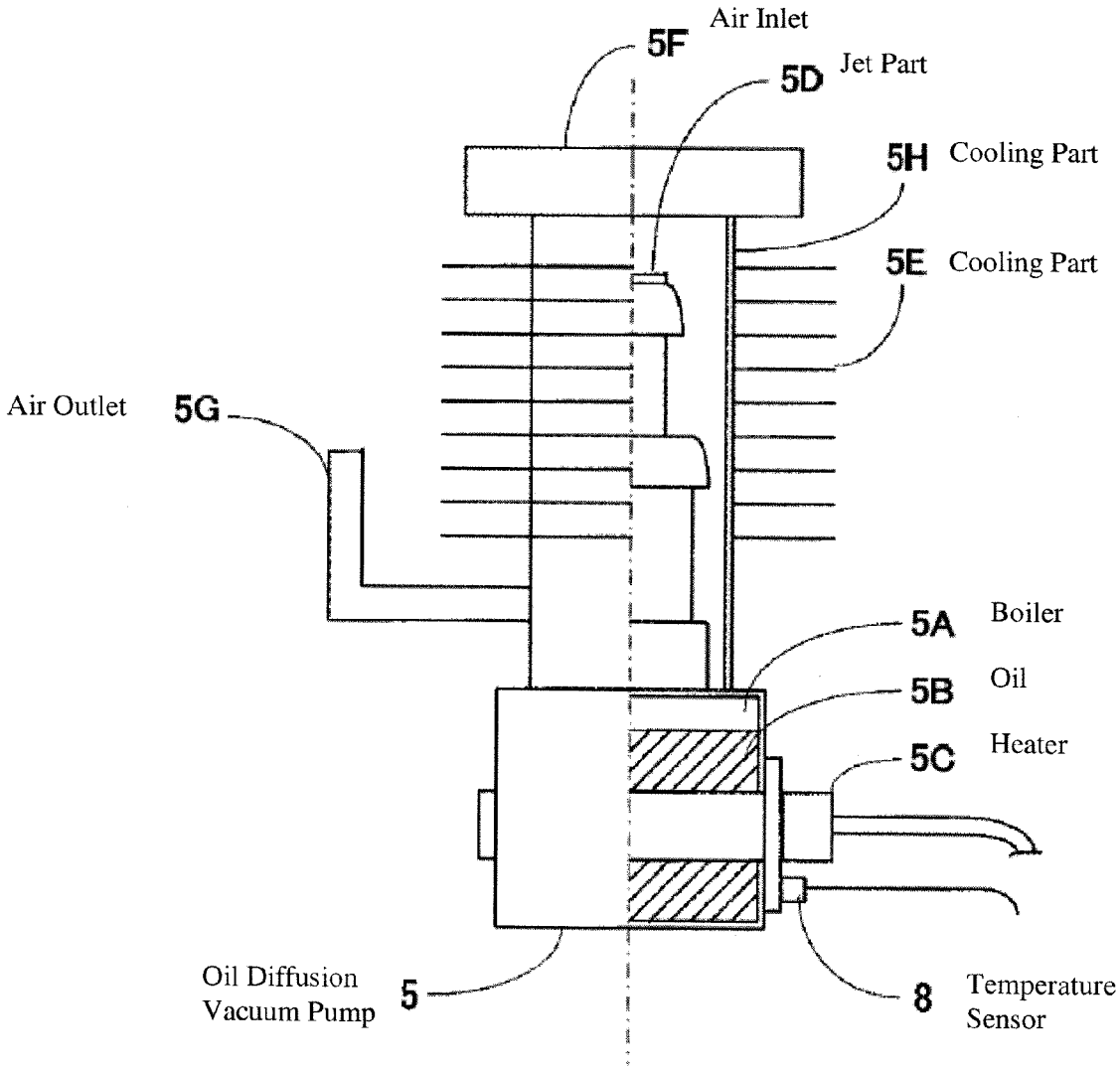
FIG. 2 is an illustration showing the structure of the oil diffusion vacuum pump shown in FIG. 1.

FIG. 2 is a partial cross-sectional view showing the structure of the oil diffusion vacuum pump 5. The oil diffusion vacuum pump 5 includes a boiler 5A, oil 5B, a heater 5C, a jet stream generation part (jet part) 5D, a cooling part (5E, 5H) including fins 5E and a body 5H, an air inlet 5F, and an air outlet (elbow part) 5G. The boiler 5A evaporates/gasifies the stored oil 5B by means of the heater 5C. The oil 5B is stored in the boiler 5A. The boiling point of the oil 5B varies depending on the type of the oil and, for example, 215° C. The heater 5C heats the oil 5B. The heater 5C consists of a heater mounted in the oil such as a cartridge heater, thereby has high heat transfer efficiency to the oil 5B and raises the temperature of the oil 5B in a short time. The jet part 5D ejects the oil molecules heated by the boiler 5A and evaporated/gasified in one direction. The cooling part (5E, 5H) cools and liquefies the high speed, gasified oil molecules ejected from the jet part 5D. The air inlet 5F is connected to the rotation chamber 3 by the pipe 7. The air outlet 5G is connected to the auxiliary vacuum pump 4 by the vacuum hose 6.

Figure 3:
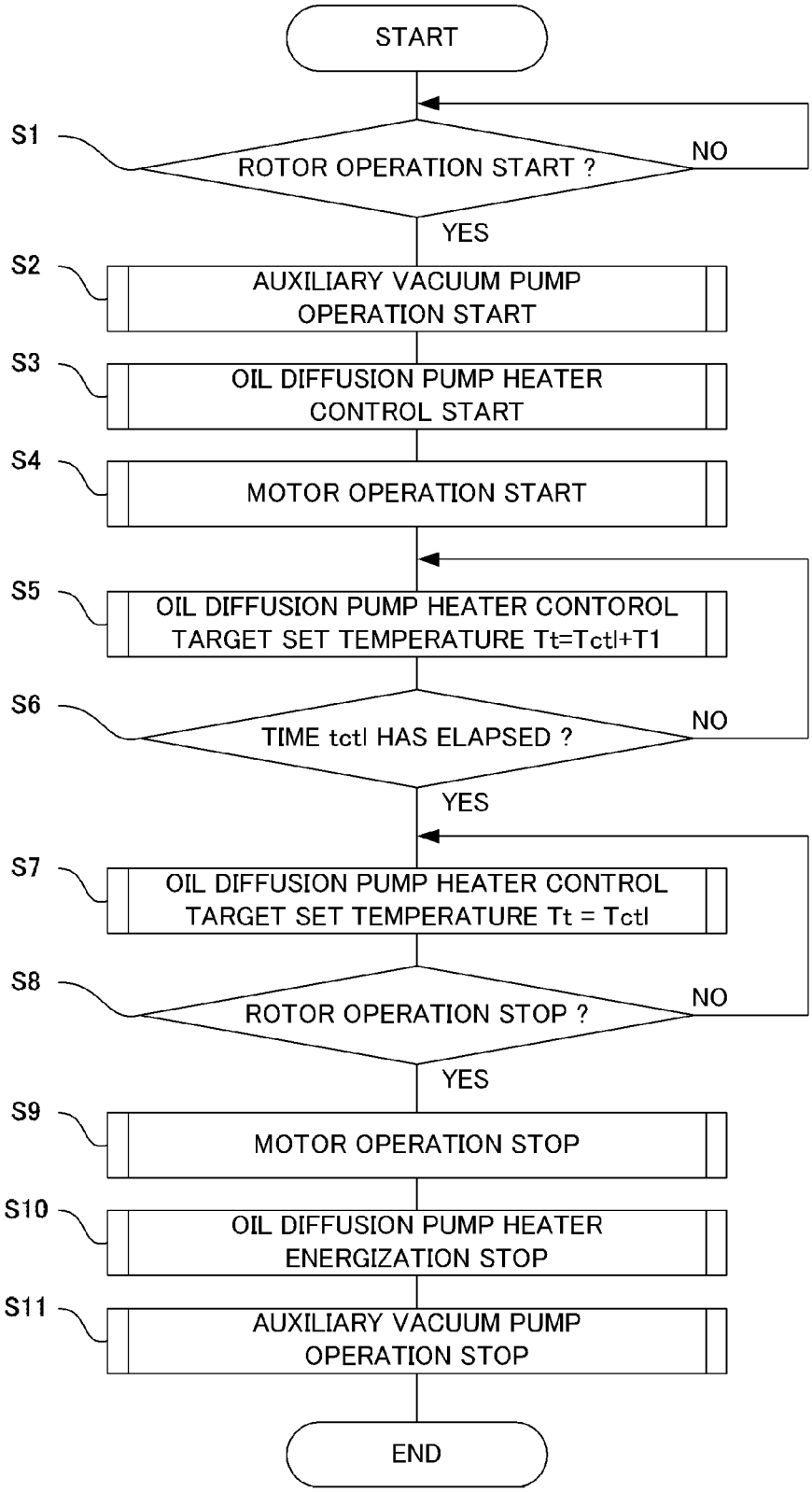
FIG. 3 is an operation flowchart of the control unit according to Embodiment 1 of the present invention.

Operation of the centrifuge 100 will be described hereafter with reference to FIG. 3. FIG. 3 is an operation flowchart of the control unit 9.

With the start switch of the input unit 10 being pressed, the input unit 10 supplies a rotor operation start signal to the control unit 9. Detecting the rotor operation start signal from the input unit 10 (Step S1, YES), the control unit 9 starts operating the auxiliary vacuum pump 4 (Step S2) and starts controlling the heater 5C of the oil diffusion vacuum pump 5 (Step S3). Subsequently, the control unit 9 starts operating the motor 2 that rotates the rotor 1 (Step S4).

Figure 8:
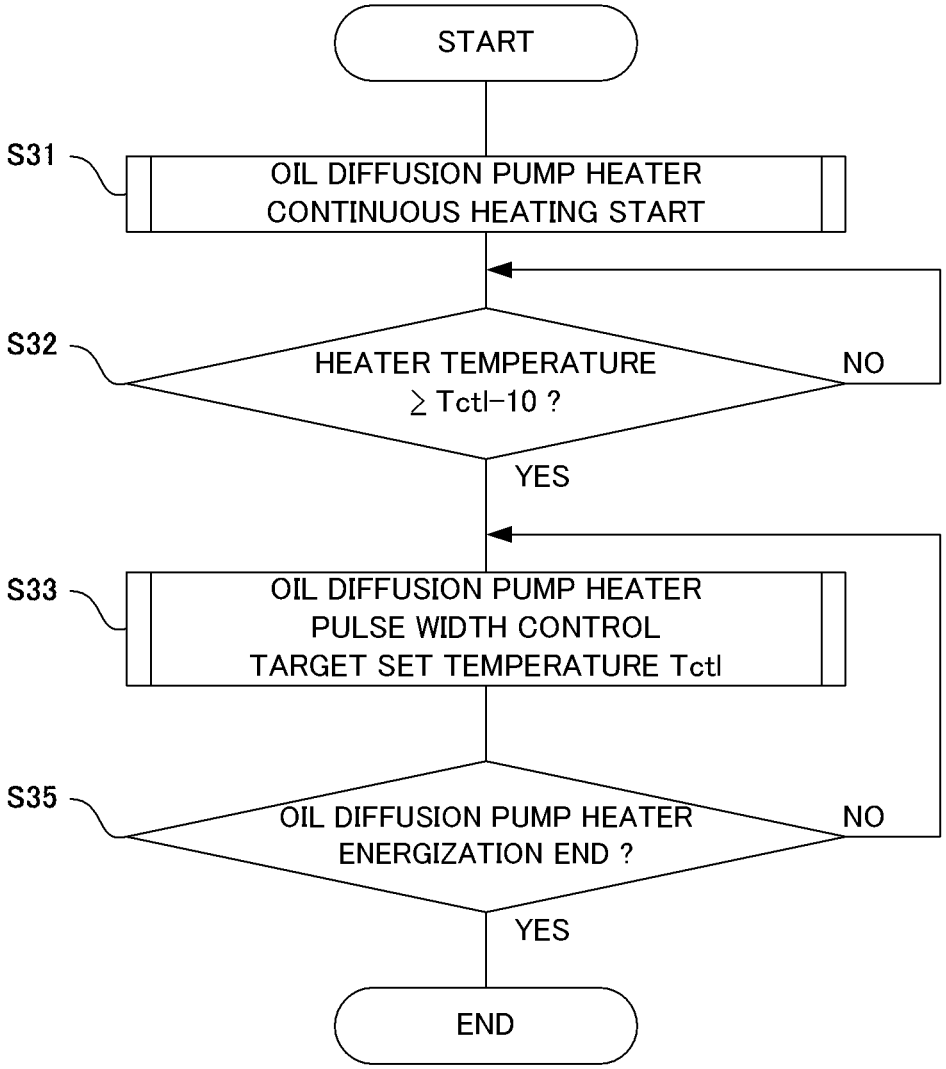
FIG.8 PRIOR ART
FIG. 8 is an operation flowchart of the oil diffusion pump heater control procedure of the control unit of a prior art centrifuge.
Figure 9:
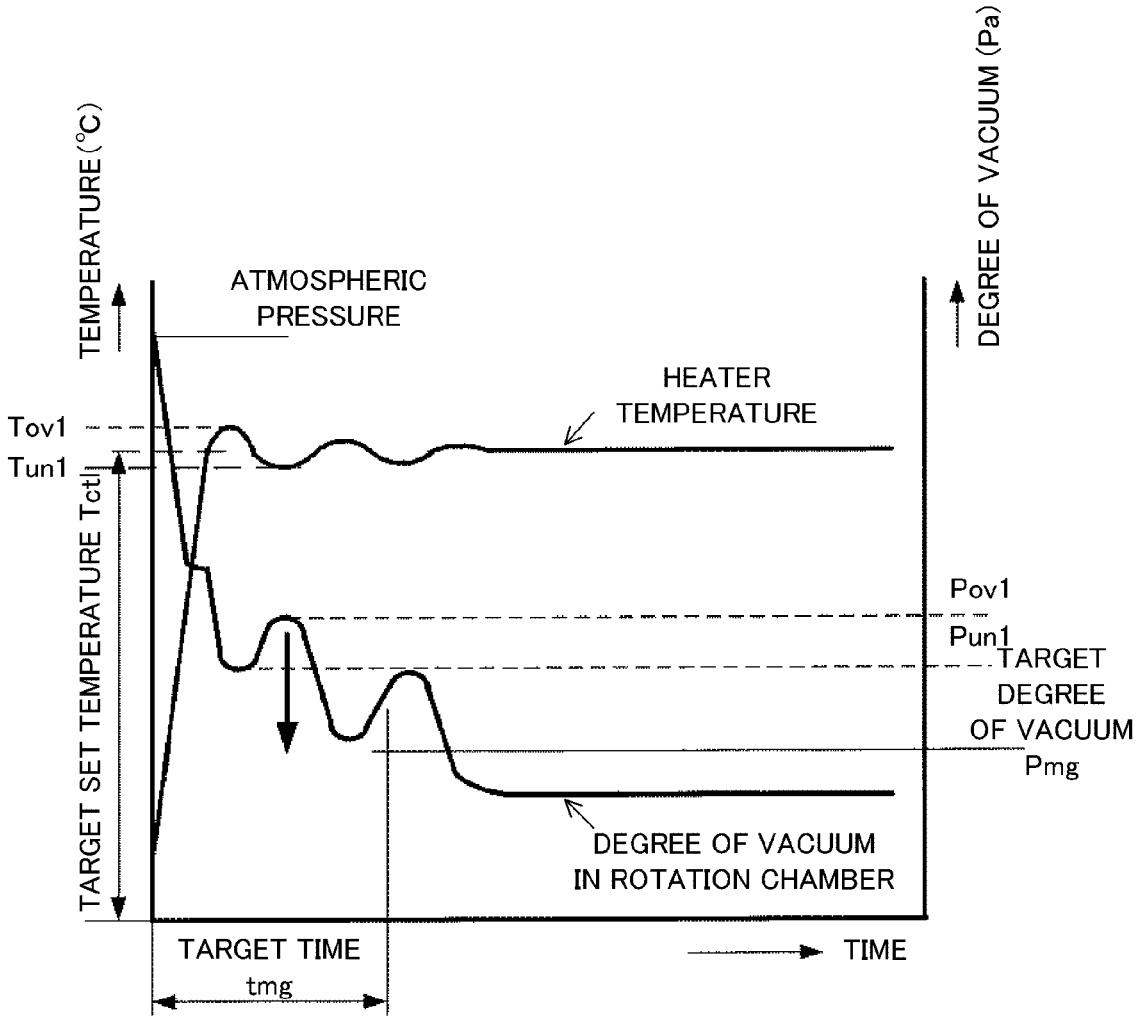
FIG.9 PRIOR ART
FIG. 9 is a characteristic chart showing measurements of the chronological change in the degree of vacuum and heater temperature of a prior art centrifuge.

Here, the procedure in Step S3 is realized by the procedures for the oil diffusion vacuum pump heater control in Steps S31 to S33 shown in FIG. 8. In this regard, the target set temperature (hereinafter, Tt) of the heater 5C is set to a first given temperature (Tctl+T1) that is higher than a second given temperature Tctl that is determined in advance to reach and maintain a target degree of vacuum in the rotation chamber by a given temperature T1. More specifically, the control unit 9 starts continuously energizing the heater 5C (Step S31). Subsequently, the control unit 9 continues to continuously energize the heater 5C until the temperature of the heater 5C (the heater temperature) reaches the first given temperature (Tctl+T1)-10° C. (Step S32, NO) based on output signals from the temperature sensor 8 attached to the heater 5C. When the heater temperature reaches the first given temperature (Tctl+T1)-10° C. (Step S32, YES), the control unit 9 controls the pulse width of the electric power supplied to the heater 5C through PID feedback control and pulse width modulation (PWM) control so that the heater temperature becomes equal to the first given temperature (Tctl+T1) (Step S33).

Subsequently, as shown in FIG. 3, the control unit 9 continues to control the heater 5C of which the target set temperature Tt is the first given temperature (Tctl+T1) (Step S5). Then, the control unit 9 measures the elapsed time since the start of control of the heater 5C using the internal timer (Step S6). The control unit 9 continues the procedure in Step S5 until a predetermined given period of time tctl elapses since the start of control of the heater 5C (Step S6, NO). After the given period of time tctl elapses since the start of control of the heater 5C (Step S6, YES), the control unit 9 changes the target set temperature Tt of the heater 5C from the first given temperature (Tctl+T1) to the second given temperature Tctl and continues to control the heater 5C (Step S7).

With the stop switch of the input unit 10 being pressed, the input unit 10 supplies a rotor operation stop signal to the control unit 9. Detecting the rotor operation stop signal (Step S8, YES), the control unit 9 stops the motor 2 rotating the rotor 1 so as to stop the rotor 1 (Step S9). After the rotor 1 stops, the control unit 9 discontinues the energization of the heater 5C of the oil diffusion vacuum pump 5 (Step S10) and stops the auxiliary vacuum pump unit 4 (Step S11).

Here, the second given temperature Tctl is set to an optimum temperature for reducing the pressure within the rotation chamber 3 while reducing the oil consumption of the oil diffusion vacuum pump 5 and the rise in temperature at the air outlet 5H. Furthermore, the given temperature T1 and first given temperature (Tctl+T1) are determined so that the heater temperature does not become lower than the second given temperature Tctl due to hunting after it reaches the first given temperature (Tctl+t1). The given period of time tctl is determined so that hunting in the heater temperature subsides in that period of time. The second given temperature Tctl, first given temperature (Tctl+T1), given period of time tctl are determined in advance based on experiments and/or simulations.

Figure 4:
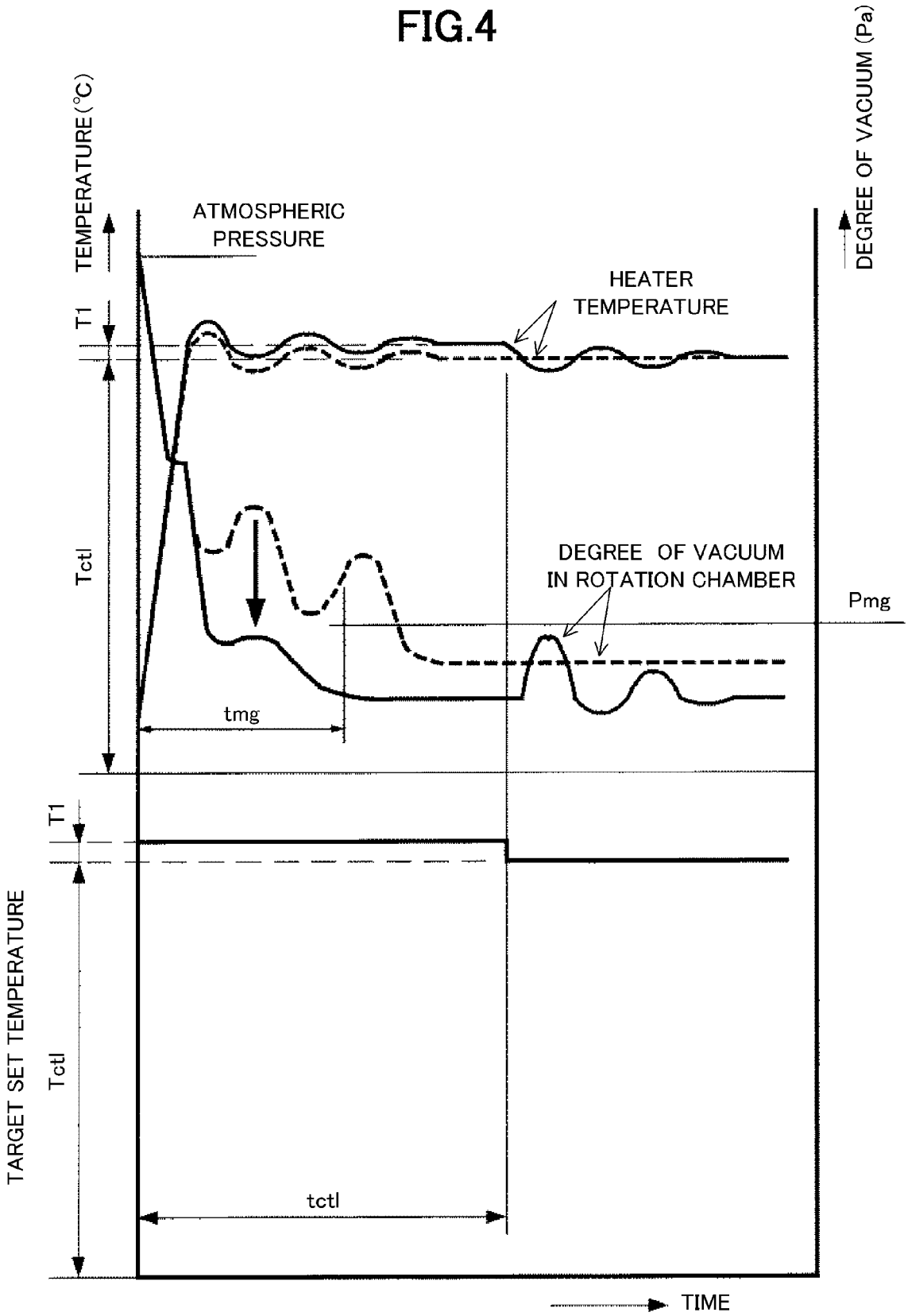
FIG. 4 is a characteristic chart showing measurements of the chronological change in the degree of vacuum and heater temperature of a centrifuge according to Example 1 of the present invention.

Chronological change in the heater temperature of the oil diffusion vacuum pump 5 and the degree of vacuum in the rotation chamber 3 in Example 1 will be described hereafter with reference to FIG. 4. In FIG. 4, the solid lines show the heater temperature and degree of vacuum of this example and the broken lines show the heater temperature and degree of vacuum of a prior art centrifuge. In this example, the given period of time tctl is 30 seconds and the given temperature T1 is 7° C.

After the control unit 9 starts continuously energizing the heater 5C, the heater temperature of the oil diffusion pump 5 linearly rises until it reaches the first given temperature (Tctl+T1)-10° C. Subsequently, the control unit 9 moves on to the pulse width control of the electric power supplied to the heater 5C of which the target set temperature Tt is the first given temperature (Tctl+T1); then, the heater temperature of the oil diffusion pump 5 reaches the first given temperature (Tctl+T1) and gradually stabilizes at the first given temperature (Tctl+T1) after some hunting. Here, because the given temperature T1 (7° C.) is properly determined, the heater temperature does not become lower than the second given temperature Tctl even if the heater temperature undershoots. Consequently, the oil 5B in the boiler 5A of the diffusion vacuum pump 5 is vigorously evaporated/gasified by the boiler 5A and powerfully ejected from the jet part 5D. Then, the rotation chamber 3 can reach a high degree of vacuum in a stable manner and in a short time.

This example can well fulfill a target period of time tmg of 5 minutes for reducing the pressure within the rotation chamber 3 to a target degree of vacuum Pmg of 13 Pa. When the heater 5C is controlled without changing the target set temperature (Tt=Tctl) as in a prior art centrifuge, the degree of vacuum achievable in the rotation chamber 3 is approximately 1.3 Pascal. However, in this example, the rotation chamber 3 can reach a degree of vacuum of approximately 0.4 Pascal as a result of improved air discharge ability of the oil diffusion vacuum pump 5.

Furthermore, if the control of the heater 5C of which the target set temperature Tt is the first given temperature (Tctl+T1) is continued for a prolonged time, some of the gasified oil molecules ejected from the jet part 5D are not cooled enough by the body 5H of the cooling part (5E, 5H) and continuously escape from the air outlet 5G of the oil diffusion vacuum pump 5 to the auxiliary vacuum pump 4. Then, the quantity of oil stored in the oil diffusion vacuum pump 5 may rapidly be reduced. However, with the duration of control of the heater 5C of which the target set temperature Tt is the first given temperature (Tctl+T1) being limited to the given period of time tctl, the rotation chamber 3 reaches an ultrahigh degree of vacuum in a stable manner and reduction in the amount of oil stored in the oil diffusion vacuum pump 5 is prevented as much as possible.

(Embodiment 2)

In Example 1, as shown in FIG. 4, after the given period of time tctl elapses and the control unit 9 changes the target set temperature of the heater 5C from the first given temperature (Tctl+T1) to the second given temperature Tctl, the heater temperature overshoots and undershoots (hunting) until it stabilizes at the second given temperature Tctl. The degree of vacuum in the rotation chamber 3 accordingly fluctuates. Therefore, there is a problem that the degree of vacuum in the rotation chamber 3 cannot be maintained in a stable manner.

In Embodiment 2 described below, the target set temperature of the heater 5C is gradually changed from the first given temperature (Tctl+T1) to the second given temperature Tctl, whereby the above problem is resolved.

Figure 5:
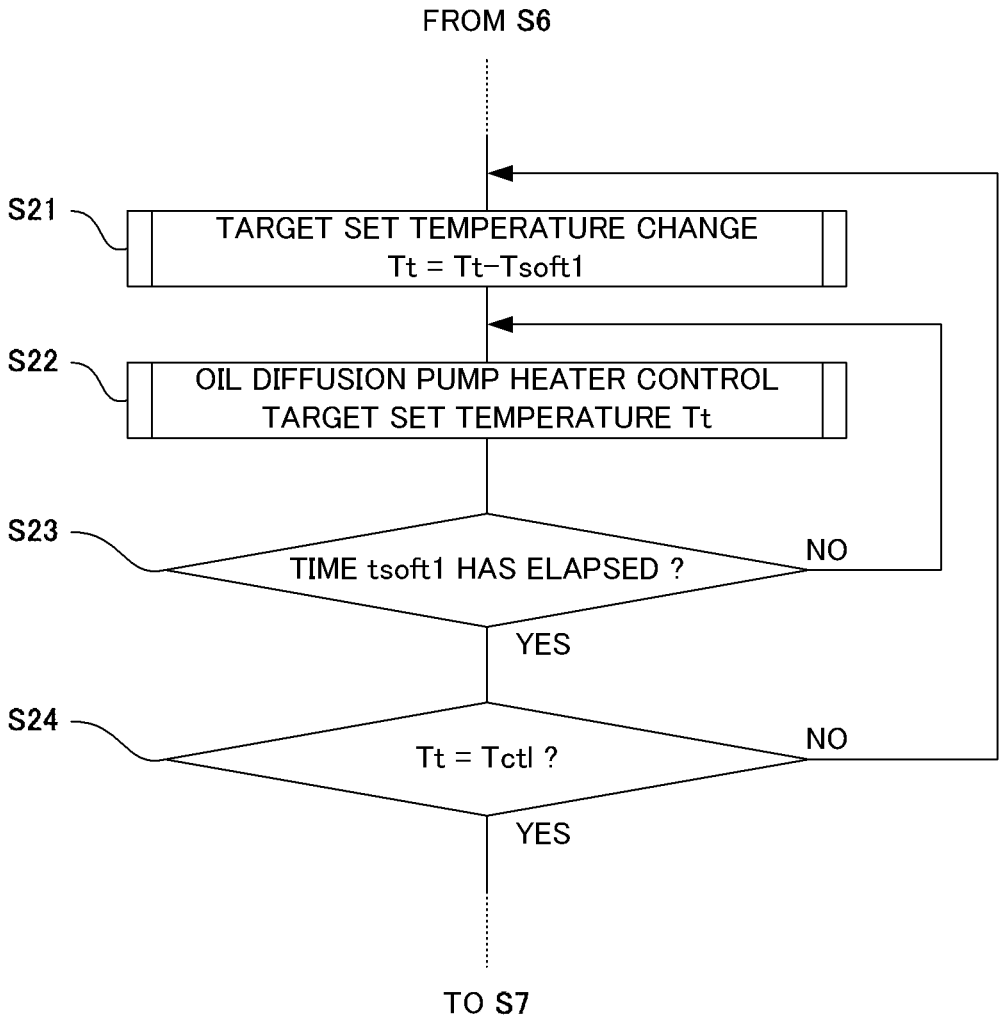
FIG. 5 is an operation flowchart of the control unit according to Embodiment 2 of the present invention.

Operation of the centrifuge 100 according to Embodiment 2 will be described hereafter with reference to FIGS. 3 and 5. FIG. 5 is an operation flowchart of the control unit 9 that is added between Steps S6 and S7 in FIG. 3.

First, the control unit 9 performs the procedures in Steps S1 to S6 shown in FIG. 3. After the given period of time tctl elapses since the start of control of the heater temperature (Step S6, YES), the control unit 9 lowers the target set temperature Tt of the heater 5C by a predetermined given temperature Tsoft1 as shown in FIG. 5 (Step S21). Subsequently, the control unit 9 continues to control the heater 5C so that the heater temperature becomes equal to the changed target set temperature Tt (Step S22). The control unit 9 measures the elapsed time since the target set temperature Tt is changed using the internal timer (Step S23) while it continues the procedure in Step S22 until a predetermined given period of time tsoft1 elapses since the target set temperature Tt is changed (Step S23, NO). After the given period of time tsoft1 elapses since the target set temperature Tt is changed (Step S23, YES), the control unit 9 repeats the above procedures (Step S24, NO) until the target set temperature Tt of the heater 5C is lowered to the second given temperature tctl (Step S24; YES). Subsequently, after the target set temperature Tt of the heater 5C is lowered to the second given temperature tctl (Step S24, YES), the control unit 9 performs the procedures in Steps S7 to S11 shown in FIG. 3.

Figure 6:
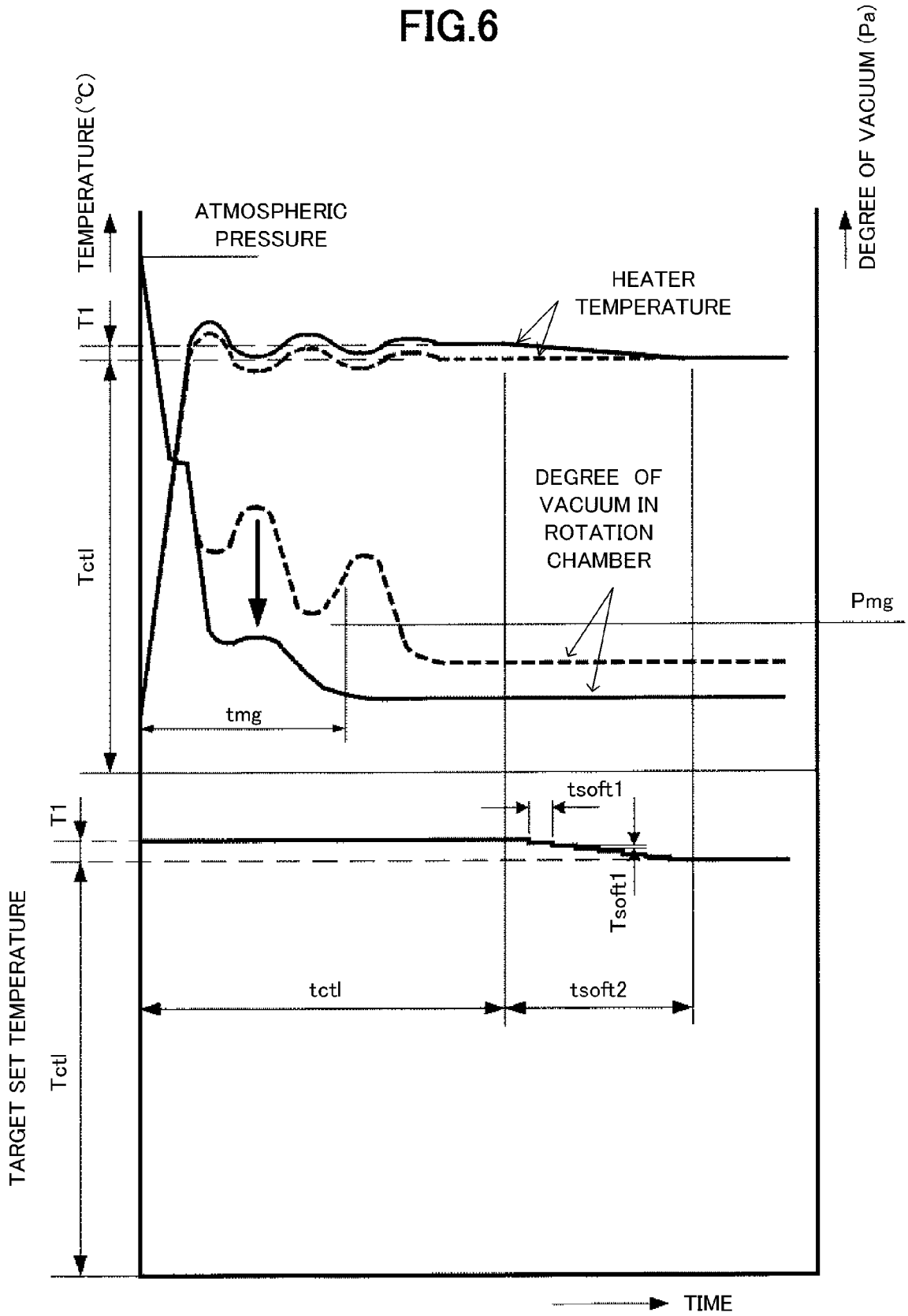
FIG. 6 is a characteristic chart showing measurements of the chronological change in the degree of vacuum and heater temperature of a centrifuge according to Example 2 of the present invention.

Chronological change in the heater temperature of the oil diffusion vacuum pump 5 and the degree of vacuum in the rotation chamber 3 in Example 2 will be described hereafter with reference to FIG. 6. In FIG. 6, the solid lines show the heater temperature and degree of vacuum of this example and the broken lines show the heater temperature and degree of vacuum of a prior art centrifuge. In this example, the given period of time tctl is 30 seconds and the given temperature T1 is 7° C. as in Example 1. The given period of time tsoft1 is 20 seconds and the given temperature Tsoft1 is 0.166° C.

After the given period of time tctl elapses since the start of control of the heater temperature, the control unit 9 lowers the target set temperature of the heater 5C stepwise by the given temperature Tsoft1 (0.166° C.) in every given period of time tsoft1 (20 seconds), namely to a repeat count of 42 in the given period of time tsoft2 of 840 seconds, whereby the target set temperature is gradually changed from the first given temperature (Tctl+T1) to the second given temperature Tctl. In this way, such extremely small change in the target set temperature prevents hunting in the heater temperature and the heater temperature changes in a stable manner. Therefore, the rotation chamber 3 can reach a high degree of vacuum in a stable manner. For easier understanding, the given period of time tsoft1 is prolonged, the given temperature Tsoft1 is enlarged, and the repeat count is reduced in FIG. 6.

The target set temperature of the heater 5C can continuously be changed instead of being changed stepwise.

(Embodiment 3)

The oil molecules heated in the boiler 5A of the oil diffusion vacuum pump 5 and evaporated/gasified and ejected from the jet part are more efficiently condensed on the body 5H of the cooling part (5E, 5H) and the air molecules trap efficiency is increased as the outside air temperature is lower. Therefore, the heater temperature optimum for reaching and maintaining an ultrahigh degree of vacuum in the rotation chamber 3 while preventing the oil diffusion vacuum pump 5 from increasing the oil consumption and raising the temperature at the air outlet 5G varies depending on the outside air temperature. Then, the centrifuge 100 according to Embodiment 3 corrects the target set temperature Tt (second given temperature Tctl) of the heater 5C according to the outside air temperature.

It is unpractical to measure the actual outside air temperature of the centrifuge 100 because a temperature sensor has to be provided outside the centrifuge 100. On the other hand, the centrifuge 100 is usually equipped with a ventilation unit such as a fan for interior ventilation. Therefore, focusing on the relationship between the outside air temperature and interior temperature of the centrifuge 100, the internal temperature of the centrifuge 100 can be measured and substituted for the outside air temperature. Most conveniently, a second temperature sensor 15 for detecting the ambient temperature of the control board 14 (the board temperature) is provided on the control board 14 housed in the control casing (enclosure) 12 having the fan (ventilation unit) 13 as shown in FIG. 1.

Figure 7:
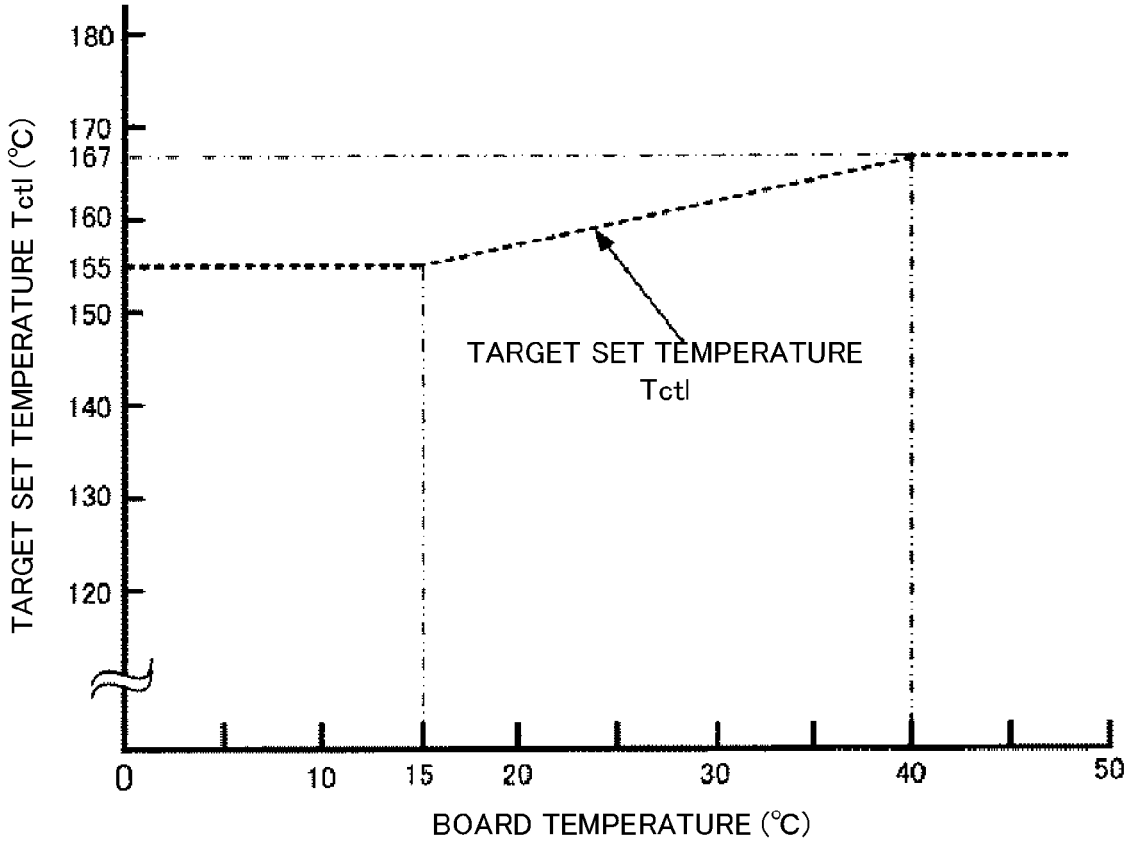
FIG. 7 is a characteristic chart showing the relationship between the outside air temperature (board temperature) and optimum heater target set temperature of a centrifuge according to Example 3 of the present invention.

In such a case, it is found in experiments that the board temperature within the control casing 12 is higher than the outside air temperature of the centrifuge 100, for example, by approximately 3° C. Furthermore, as shown in FIG. 7, the relationship between the board temperature within the control casing 12 and the optimum target set temperature Tt (the second given temperature Tctl) of the heater 5C is obtained from experiments. Using this relationship, the control unit 9 determines the optimum target set temperature Tt (the second given temperature Tctl) of the heater 5C based on the board temperature detected by the second temperature sensor 15. In this way, the rotation chamber 3 can reach and maintain an ultrahigh degree of vacuum in a reliable manner while preventing the oil diffusion vacuum pump 5 from increasing the oil consumption and raising the temperature at the air outlet 5G.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A centrifuge comprising:

a rotor for holding a sample;

a rotation chamber for housing the rotor;

a motor for rotating the rotor, an oil diffusion pump for reducing a pressure within the rotation chamber;

a heater for heating oil in the oil diffusion pump;

a first temperature sensor for detecting temperature of the heater; and a control unit for controlling the heater temperature of the oil diffusion pump for a target set temperature, wherein the control unit changes the target set temperature from a first given temperature to a second given temperature that is lower than the first given temperature after a given period of time elapses since the start of control of the heater temperature.

2. The centrifuge according to claim 1, wherein the control unit gradually changes the target set temperature from the first given temperature to the second given temperature.

3. The centrifuge according to claim 1, wherein the control unit determines the second given temperature based on the outside air temperature of the centrifuge.

4. The centrifuge according to claim 3, further comprising:

a second temperature sensor for detecting the internal temperature of the centrifuge and outputting detection signals indicating the detected internal temperature to the control unit, wherein the control unit determines the second given temperature based on the detection signals output from the second temperature sensor and the predetermined relationship between the outside air temperature and the internal temperature.

5. The centrifuge according to claim 4, wherein the second temperature sensor is housed in an enclosure having a ventilation unit together with the control unit.

6. The centrifuge according to claim 1, wherein the first given temperature is determined so that the heater temperature does not become lower than the second given temperature due to hunting after it reaches the first given temperature.

7. The centrifuge according to claim 1, wherein the given period of time is determined so that it is longer than the time for hunting in the heater temperature to subside since the start of control of the heater temperature.

8. The centrifuge according to claim 1, wherein the first temperature sensor outputs detection signals indicating the detected heater temperature to the control unit, and the control unit controls the heater temperature based on the detection signals output from the first temperature sensor.

9. The centrifuge according to claim 1, wherein the heater is a cartridge heater.

10. A control method of a centrifuge having a rotor for holding a sample, a rotation chamber for housing the rotor, an oil diffusion pump including a heater for heating oil in the oil diffusion pump and a sensor for detecting temperature of the heater, the control method comprising steps of:

starting to heat the heater of the oil diffusion pump;

controlling the temperature of the heater for a first given temperature; and controlling the temperature of the heater for a second given temperature that is lower than the first given temperature after a given period of time elapses since the start of heating of the heater.

11. The control method according to claim 10, wherein the heater temperature is gradually lowered from the first given temperature to the second given temperature.

12. The control method according to claim 10, wherein the second given temperature is determined based on the outside air temperature of the centrifuge.

13. The control method according to claim 12, wherein the second given temperature is determined based on the internal temperature of the centrifuge and a predetermined relationship between the outside air temperature and internal temperature.

14. The control method according to claim 10, wherein the first given temperature is determined so that the heater temperature does not become lower than the second temperature due to hunting after it reaches the first given temperature.

15. The control method according to claim 10, wherein the given period of time is determined so that it is longer than the time for hunting in the heater temperature to subside since the start of control of the heater temperature.

* * * * *